US011885580B2

(12) United States Patent
Bilgeri

(10) Patent No.: US 11,885,580 B2
(45) Date of Patent: Jan. 30, 2024

(54) WEAPON WITH CARTRIDGE-CASE EJECTION

(71) Applicant: GLOCK TECHNOLOGY GMBH, Ferlach (AT)

(72) Inventor: Elmar Bilgeri, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 155 days.

(21) Appl. No.: 17/754,132

(22) PCT Filed: Sep. 30, 2020

(86) PCT No.: PCT/EP2020/077390
§ 371 (c)(1),
(2) Date: Mar. 24, 2022

(87) PCT Pub. No.: WO2021/064033
PCT Pub. Date: Apr. 8, 2021

(65) Prior Publication Data

US 2023/0341203 A1 Oct. 26, 2023

(30) Foreign Application Priority Data

Oct. 4, 2019 (EP) ..... 19201440

(51) Int. Cl.
*F41A 15/14* (2006.01)
*F41A 3/26* (2006.01)
(Continued)

(52) U.S. Cl.
CPC ..... *F41A 3/26* (2013.01); *F41A 3/66* (2013.01); *F41A 5/18* (2013.01); *F41A 15/10* (2013.01); *F41A 15/14* (2013.01)

(58) Field of Classification Search
CPC ..... F41A 15/12; F41A 15/14
See application file for complete search history.

(56) References Cited

U.S. PATENT DOCUMENTS 1,564,014 A * 12/1925 Pedersen ..... F41A 15/14 42/25
3,566,744 A * 3/1971 Stoner ..... F41A 3/78 89/1.4

(Continued)

FOREIGN PATENT DOCUMENTS

CH 162176 A * 6/1933
CZ 283180 B6 * 1/1998 ..... F41A 3/40

(Continued)

*Primary Examiner* — Gabriel J. Klein
(74) *Attorney, Agent, or Firm* — Raven Patents, LLC; Anton E. Skaugset

(57) ABSTRACT

Firearms with cartridge-case ejection, including a barrel with a movable bolt carrier with a bolt, with a breech face, with a movable ejector and with a firearm-fixed functional edge which pushes the ejector into its ejection position when the bolt carrier moves back after a shot has been fired. In order to create an ejection that is always evenly performed, an ejector lever is arranged on the bolt carrier so that it can be rotated about a pivot axis running normal to the firearm's central plane, which abuts against the functional edge when the bolt carrier moves backwards and thereby twisted so that it abuts an impact surface of the ejector and forces it to the eject position.

25 Claims, 7 Drawing Sheets

(51) Int. Cl.

| | |
|---|---|
| ***F41A 3/66*** | (2006.01) |
| ***F41A 5/18*** | (2006.01) |
| ***F41A 15/10*** | (2006.01) |

(56) References Cited

U.S. PATENT DOCUMENTS

| | | | | | |
|---|---|---|---|---|---|
| 4,398,448 | A * | 8/1983 | LaFever | F41A 3/26 | 89/185 |
| 4,635,530 | A * | 1/1987 | Weldle | F41A 3/26 | 89/193 |
| 4,676,017 | A * | 6/1987 | Hurlemann | F41A 15/14 | 42/25 |
| 7,568,422 | B1 * | 8/2009 | Barrett | F41A 3/26 | 89/190 |
| 2002/0026739 | A1 * | 3/2002 | Murello | F41A 15/14 | 42/47 |
| 2004/0055198 | A1 * | 3/2004 | Gussalli Beretta | F41A 15/14 | 42/46 |
| 2014/0059910 | A1 * | 3/2014 | Norton | F41A 3/72 | 42/9 |
| 2018/0313622 | A1 | 11/2018 | Dionne | | |
| 2022/0290938 | A1 * | 9/2022 | Mihola | F41A 15/14 | |

FOREIGN PATENT DOCUMENTS

| | | | | |
|---|---|---|---|---|
| DE | 3308993 | A1 * | 9/1984 | |
| DE | 3433748 | A1 * | 3/1986 | |
| EP | 1363099 | A1 | 11/2003 | |
| GB | 746227 | A * | 3/1956 | |
| GB | 746227 | A | 3/1956 | |
| SK | 278395 | B6 * | 3/1997 | F41A 3/40 |

* cited by examiner

Fig. 6
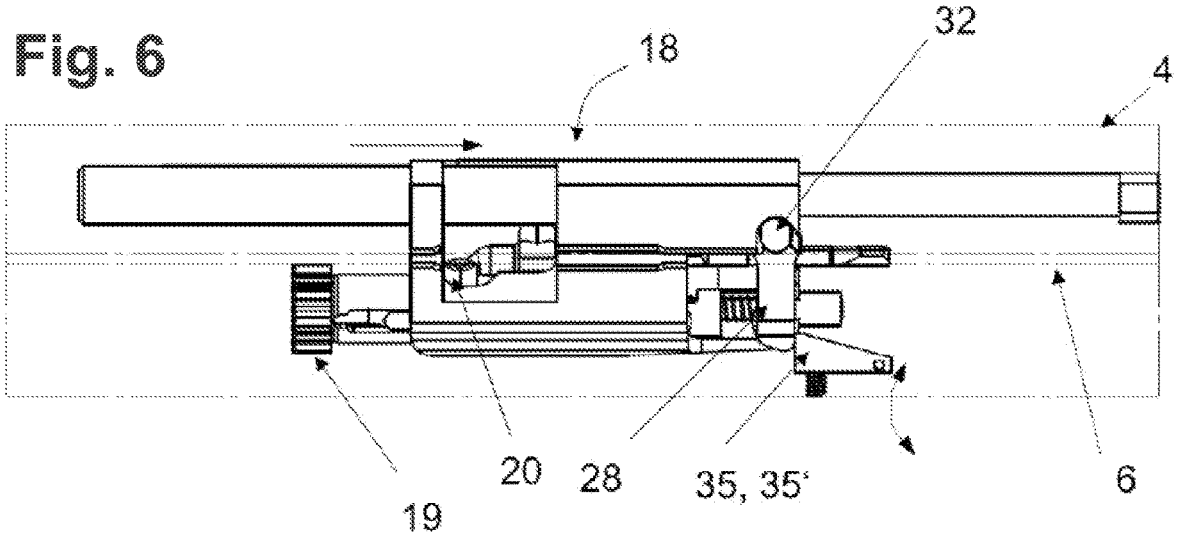
Fig. 8A
Fig. 8B
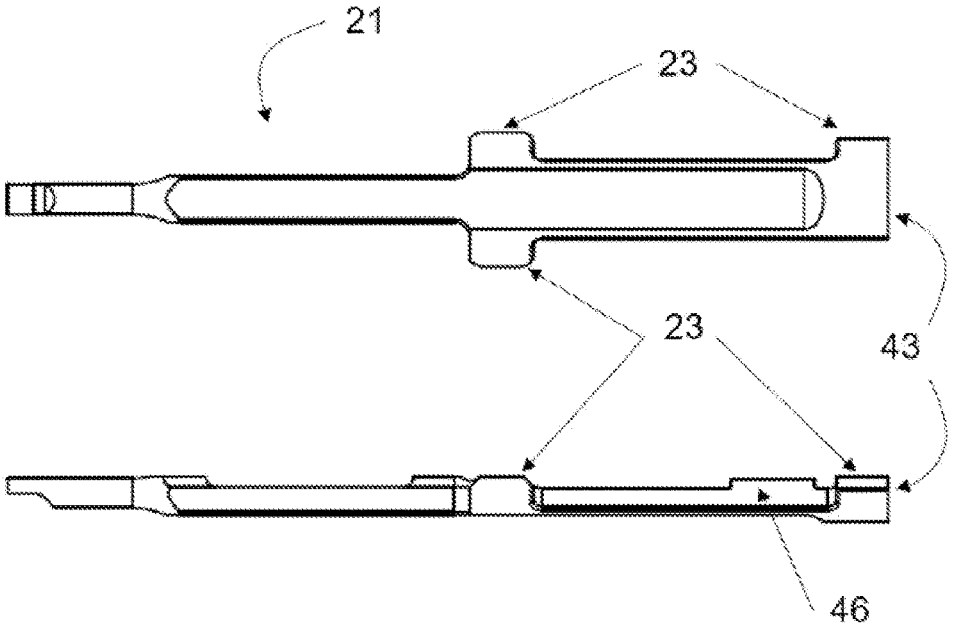

WEAPON WITH CARTRIDGE-CASE EJECTION

FIELD OF THE INVENTION

The present disclosure relates generally to firearms, and more particularly to a firearm with cartridge-case ejection, in particular a rifle.

In all firearms with relative axial movement between barrel and breech after firing a shot, such as pistols, long guns, rifles, carbine and the like, there is a mechanism for the ejection of the cartridge-case. This mechanism serves to move the case from the actual chamber of the breech with the recoiling breech to the rear to position it at a suitable point at an ejection window (often also called ejection port), usually provided on the side of the firearm housing, so that a transverse force allows it to reliably exit the window. When the bolt advances under the action of the return spring, the next cartridge can then be inserted from the magazine into the chamber.

In the prior art, an extraction claw mounted in the breech block (also referred as the bolt) is usually used to safely move the case along with the bolt. This claw encompasses the case base, which practically always has a flange or similar change in diameter in the base area, and thus ensures that the case is safely moved out of the cartridge chamber of the barrel. In this context, the part of the bolt adjacent to the case base in which the extraction claw is located is often referred to as the bolt head. The application of the transverse force, which is usually directed laterally, but in a few cases upwards, is usually brought about by the fact that the base of the case, when moving backwards, runs eccentrically onto a part connected to the frame of the gun, usually called the ejector, so that the combination of the effect of the claw, the inertia forces and the eccentric impact on the component connected to the frame (ejector, ejector pin) results in a corresponding moment or a corresponding transverse impact so that the case is ejected from the window.

In practice, there are numerous problems with this process and often framework conditions that are not easy to comply with:

The explosive pressures that occur in the chamber when the shot is ignited and the resulting high acceleration of the breech (bolt carrier) and the extractor claw must be taken into account in their design and construction, because this claw, which is pivotably mounted in the breech head, or breech piece, is usually under the action of a spring that forces it into the working position. In some cases, when the case is ejected, the extraction claw is actively rotated from the working position to an ejection position that facilitates or even enables ejection. In addition, when using different ammunition on the same gun, the movement of the bolt should be as reliable as possible, but also the interaction between the case or case base and the ejector, which may be connected to the frame of the gun, are required to also function over a wide range of velocities and thus widely varying inertial forces available. One must bear in mind that the components in question are subjected to extreme mechanical stresses, i.e. dynamic shocks, and high tribological stresses, as well as thermal stresses, and that the reliable functioning of this mechanism may have an impact on the reliability of the firearm as a whole.

What is needed is an operationally reliable ejection mechanism that fulfills the mentioned conditions and, in addition to the reliable operation is also space-saving, simply constructed and therefore inexpensive and unproblematic in maintenance. In addition, at least in one configuration the ejection mechanism of the present disclosure is capable of forcibly triggering the ejection of a fired case or also of an unfired cartridge at a defined time and/or at a defined position.

SUMMARY

The present disclosure is directed to firearms with cartridge-case ejection, the firearms including a barrel with a barrel axis; a bolt carrier that can be moved parallel to the barrel axis; a functional edge that is coupled to the firearm rearward of the bolt carrier in a direction of the barrel axis; where the bolt carrier includes a bolt that, when in a ready-to-fire position, and in combination with the barrel, forms a cartridge chamber; an ejector having a rear end that protrudes beyond the bolt carrier, where the ejector can be moved in the bolt parallel to the barrel axis between an ejector rest position in which a front end of the ejector does not protrude beyond a breech face and an ejector ejection position in which the front end of the ejector protrudes beyond the breech face; an ejector spring that urges the ejector into the ejector rest position; and an ejector lever that is arranged on the bolt carrier so that it can rotate about an ejector lever pivot axis between an ejector lever rest position and an ejector lever ejection position. The ejector lever includes a leg disposed in a path of a relative movement of the functional edge when the ejector lever is in the ejector lever rest position; and an ejector surface that, when the ejector lever is rotated from the ejector lever rest position to the ejector lever ejection position, contacts an impact surface of the ejector and pushes it into the ejector ejection position. The firearm is configured so that the functional edge urges the ejector into the ejector ejection position when the bolt carrier moves rearward after a shot has been fired.

BRIEF DESCRIPTION OF THE DRAWINGS

The firearms of the present disclosure are explained in more detail below with reference to the drawings, in which:

FIG. 6 depicts an illustrative variant of a housing stop (functional edge) according to the present disclosure, FIGS. 8A and 8B depict an ejector according to the present disclosure in two views.

DETAILED DESCRIPTION

Figure 1:
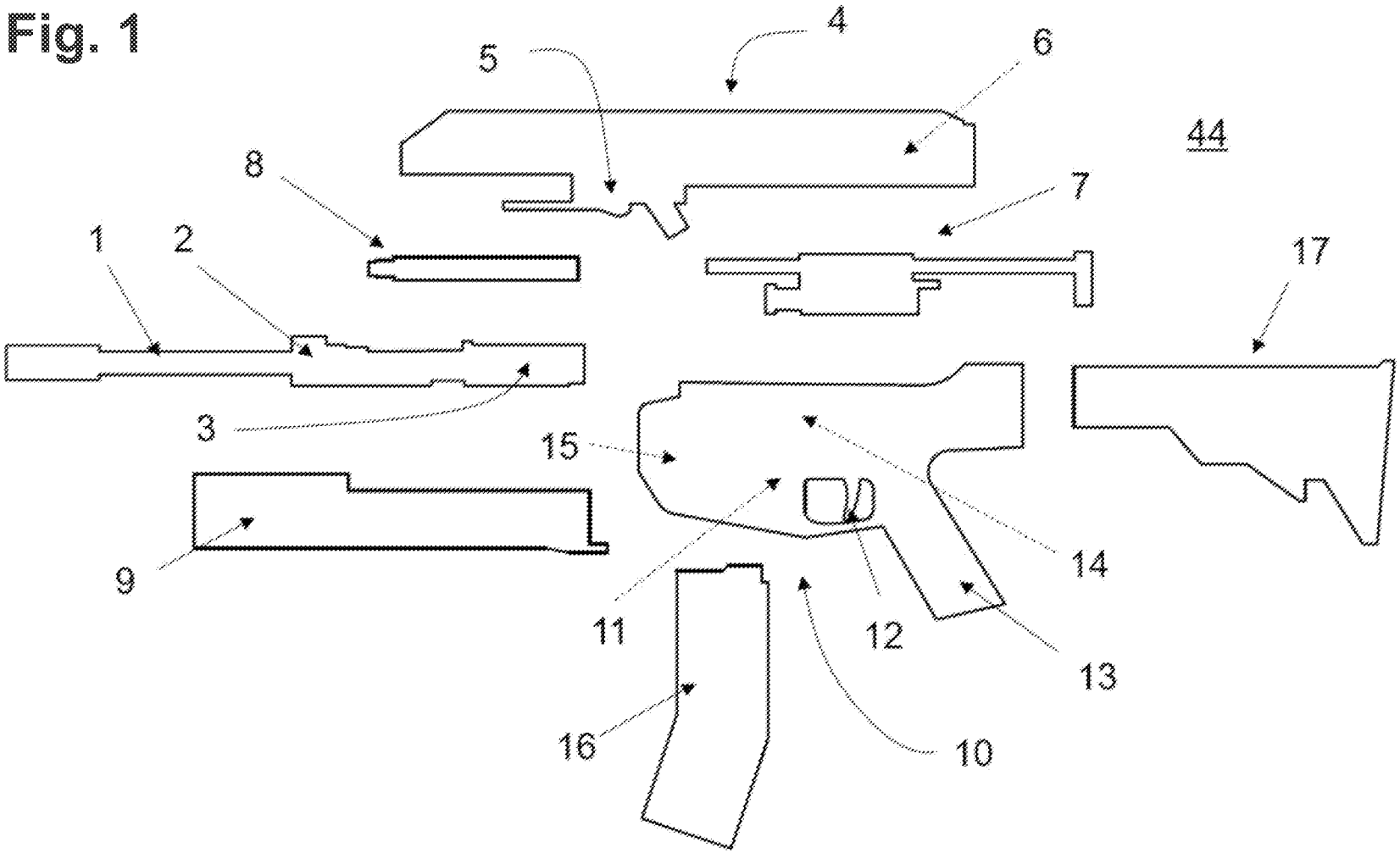
FIG. 1 shows a modular firearm with its individual modules.

The firearms of the present disclosure include an operationally reliable cartridge-case ejection mechanism, which in addition to providing reliable operation is also space-saving, and which is simply constructed and therefore inexpensive and requiring less maintenance. In at least one embodiment the disclosed firearms include a cartridge-case ejection mechanism where the ejector pin is mounted within the bolt head so as to be movable parallel to the direction of movement of the bolt head; it is under the action of a bolt spring which urges it to the rearward away from the case bottom, it cooperates with the case stop indirectly, namely through an ejector lever rotatably mounted in the bolt carrier in which the bolt is guided in its movement.

These measures ensure that when the bolt carrier is returned together with its (bolt) head, one arm of the ejector lever (ejector leg) first abuts against the housing stop, also called the functional edge, or a functional cam, such that the ejector lever is twisted, if necessary against the action of a lever spring, until it abuts against the ejector pin and pushes it with high, impact-like force, against the action of the pin spring against the case base, whereby it pushes the case off the abutment face. Since the ejector lever moves out of the relative movement path of the housing stop (functional edge) in this position, the bolt unit as a whole can be moved further back, towards the end stop, by the explosion gases or inertia, and the paths and inertial forces of the breech and breech bolt can be determined and defined independently of the activation positions and the forces that result in case ejection, which was previously not possible.

The spring loading of the ejector in the direction of its inactive position (rest position), which, however, does not have to be so far from the ejector lever that it is in (constant) contact with it, ensures that the ejector does not come out of the bolt when the next cartridge is pushed in, and that the ejector does not protrude and interfere with cartridge insertion. Due to the distance to the ejector lever, an impact-like and therefore very high power transmission is ensured, through which cartridge-cases that are firmly attached to the breech face are reliably released and ejected. The design of the ejector lever also contributes to this, due to the existence of which the lever arm from the housing stop to the pivot axis is longer than the lever arm from contact with the ejector pin to the axis of rotation, so that although its movement path is smaller, the forces that occur are greater than those of the ejector lever on the housing stop.

Spring loading by means of an ejector spring can preferably ensure the return of the ejector lever to the normal ready position (rest position) when the breech and the breech head are moved forward again by the closing spring and have thereby reached the position in which the housing stop (functional edge) no longer prevents twisting. Such an ejector spring can also ensure that the ejector pin also returns to the ready position under the action of its pin spring. The two springs are preferably designed as helical springs that work under pressure, which ensures the longest service life for springs.

In the case of the ejector bait, the springs can either be arranged with corresponding shoulders on it and its guide around it, but are preferably located in a spring chamber lying parallel to the guide hole of the firing pin, and act on at least one thickening (or also an extension or ejector wing) of the ejector, which also determines the two end positions of the ejector. Likewise, it is favorable if the ejector lever has a spring arm designed in such a way that it is under the action of a suitably arranged helical spring which works as a compression spring. The arrangement and design of such a spring arm and the guidance and mounting of the spring depend on the structure of the bolt and can be easily designed and dimensioned by a person skilled in the art who is familiar with the present disclosure and the basic design of the firearm.

Through these disclosed features and their combination, it is also possible to ensure that the ejector lies in the guide recess of the bolt over the largest area of its length and is thus protected in the best possible way against all types of bending loads. It can therefore be built to be relatively robust for the axial load that it naturally experiences without disadvantages, without becoming too bulky. In addition, the ejector batt has, at least on one side, radial, wing-like extensions, also called ejector wings, which, in cooperation with a recess provided for this purpose in the bolt, represent an axial limitation of the movement. It is also advantageous if the ejector has a radial widening or radial extensions or ejector wings at its rear end, as a result of which a larger impact surface for the ejector lever is formed.

The ejector lever can be made solid in the direction of its pivot axis, there is usually enough space available for this in the bold carrier, and it must be considered that the main stress, despite the design as a rotary lever, only occurs in the area between the contact with the housing stop (functional edge) and the contact with the ejector. There comes up a turning-sliding movement at both contact-surfaces. The part of the ejection lever lying in between can be made larger (thicker) in the circumferential direction, without impairing its mode of operation or taking up undue space, so that the forces that occur are transmitted over a sufficiently large cross section.

The contact between the ejector lever and the housing sliding surface, which is parallel to the movement of the bolt in the longitudinal direction and thus also parallel to the barrel axis, and which is adjacent to the functional edge or the functional cam, can be reduced by appropriate adjustment of the surface hardness and a rounded design of the free end of the ejector lever and/or the transition from the housing stop to the housing sliding surface can be designed after a few attempts in such a way that on the one hand the friction contributes to decelerating the breech and thus to reducing the cadence of automatic firearms, on the other hand there is no risk of damage caused by the friction that occurs. Even if the functional edge is then a functional rounding, the term functional edge is used in the present disclosure.

As can be seen in FIG. 1 purely schematically in a kind of section through the firearm center plane 44, corresponding to the plane of the drawing, a modular firearm has, for example, a barrel 1, a gas system 2, a barrel extension 3, an upper housing, also called upper 4, with a carrier module 5 and guides 6 for a bolt carrier group 7 on. It also has a charging handle unit 8, a handguard 9, a lower housing, also known as a lower 10, a magazine catch 11, a trigger unit 12, a grip 13, a bolt catch 14, a central system lock 15, a magazine 16 and a stock 17. This is just one example of a modular firearm in which the disclosed ejection mechanism can be used to advantage. Other firearms may consist of fewer or more modules, or may be constructed of modules combined in other ways, as is well known, or without any modularity.

Figure 2:
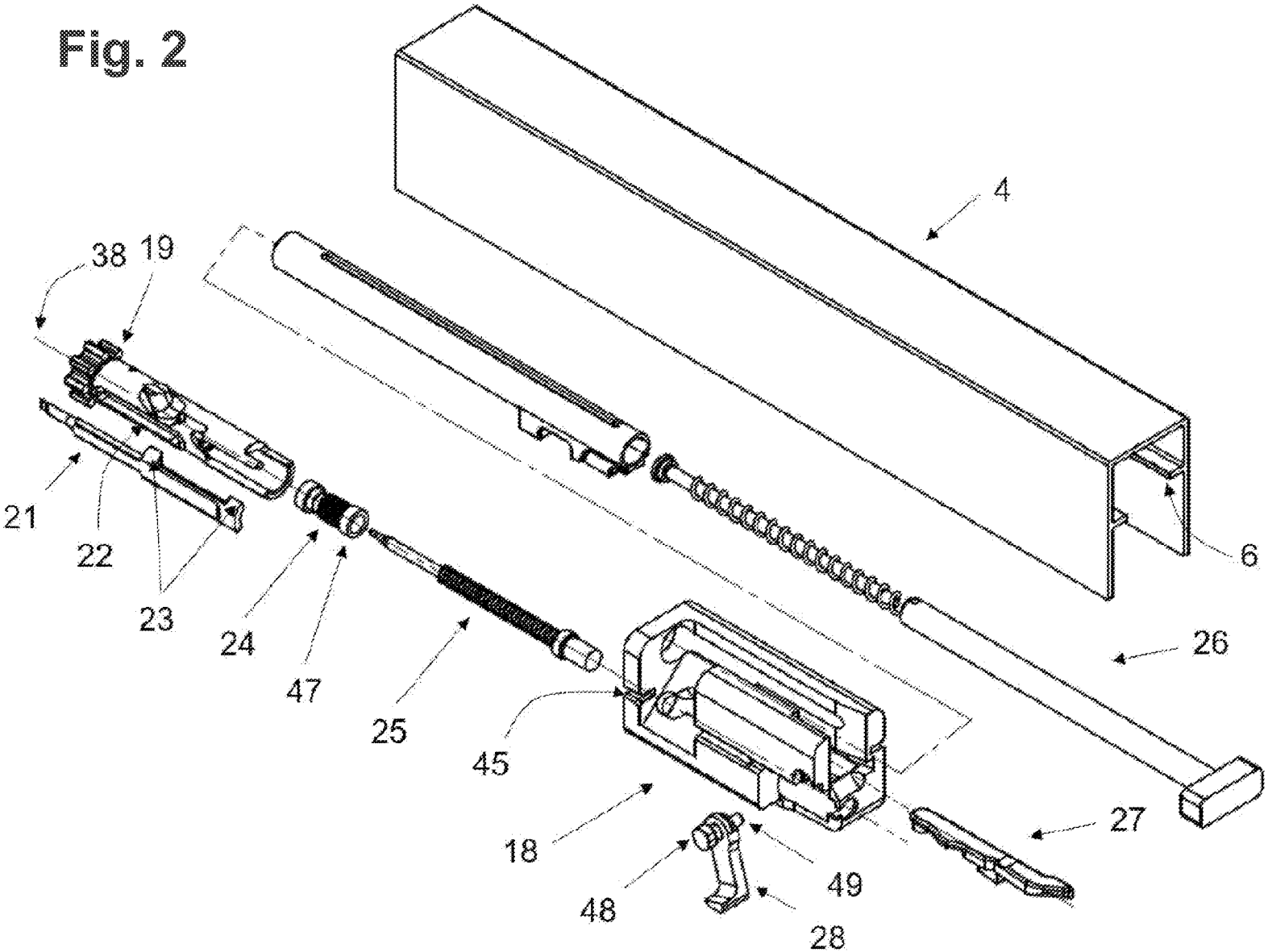
FIG. 2 is an exploded view of an illustrative closure unit according to the present disclosure.

FIG. 2 shows a perspective view of a bolt carrier 18 with a bolt 19 which has a recess 22 for an ejector 21 according to the invention, which may also be called an ejector bolt, and a central bore for a firing pin 25. The ejector 21 has two radially projecting ejector wings 23 which are axially spaced from one another and which on the one hand determine its angular position and on the other hand interact with an ejector spring 24 designed as a helical spring. The front end of the ejector spring 24 facing the barrel rests against a notch in the recess 22, and its other, rear end rests against one of the ejector wings 23 and forces it, and thus the ejector 21, off the breech face 42 (FIG. 4D). of the bolt 19 to the rear, into its rest position. Matching spring plates can be provided and, as shown, the firing pin 25 can be arranged in the core of the ejector spring, whereby a dynamic stabilization of the same is achieved.

The ejector wings 23 and the abutting surfaces of the recesses 22 in the bolt 19 that interact with them are geometrically matched to the ejector spring 24 in such a way that the axial end positions of the ejector are not determined by the spring, whose dynamic loading thus remains limited. In the rest position, the rear end of the ejector 21 protrudes axially out of the bolt 19 and forms an impact surface 43, which, as explained in more detail below, lies in the path of movement of an ejector lever 28.

Also indicated in FIG. 2, purely schematically, is a recoil spring assembly 26 which, after the bolt carrier 18 has returned, moves it back into its front, shot-ready position, and the upper housing, the upper 4, shown symbolically as a prismatic profile, with guides 6 for the bolt carrier 18, there also purely schematically, and indicated by lateral, groove-shaped recesses (slots). A firing pin safety 27, as known in the art, is also provided.

Figure 3A:
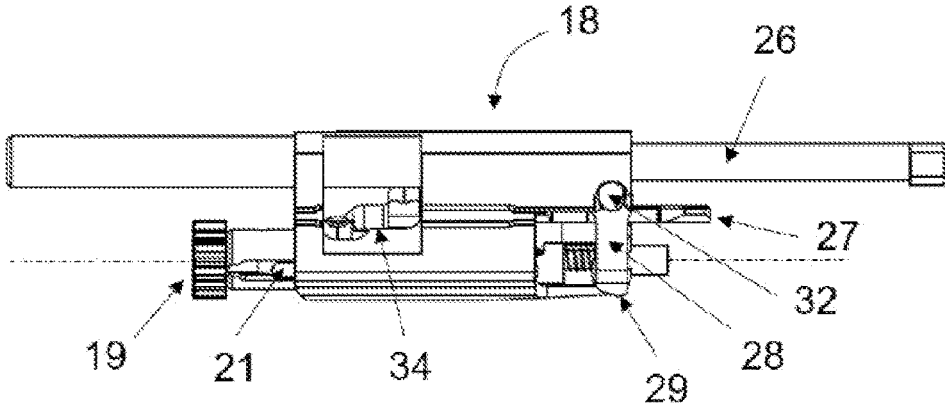
FIGS. 3A-3C depict variants of an ejector lever according to the present disclosure.
Figure 3B:
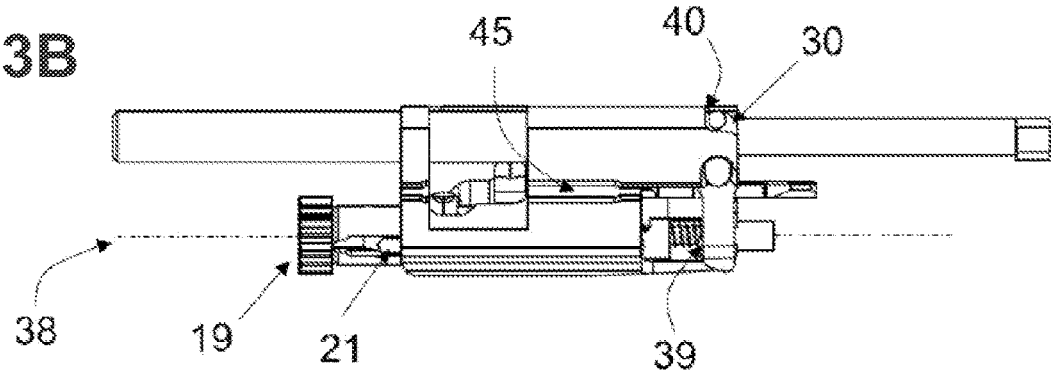
Figure 3C:
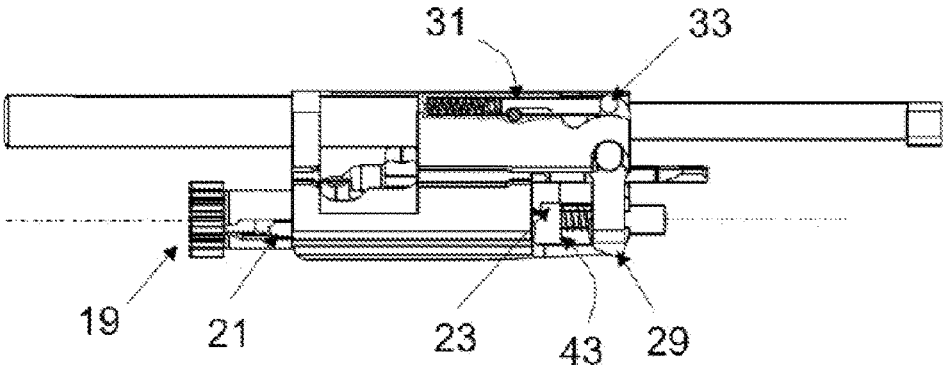

The FIGS. 3A-3C show three variants of an ejector lever 28 according to the present disclosure in its rest position: In all cases, it is mounted in the bolt carrier 18 in such a way that, in its rest position, it assumes a position running essentially perpendicular to the barrel axis 38 and is mounted such that it can pivot or rotate between two end positions about a pivot axis 32, which runs normal to the firearm center plane 44. A stop 33 on the ejector lever 28, in conjunction with a matching surface (end face) 40 on the bolt carrier 18, defines the first of these positions, the rest position. In the illustration of FIGS. 3A-3C, this corresponds to preventing any further counterclockwise rotation of the ejector lever 28.

Figures 4A, 4B, 4C, 4D:
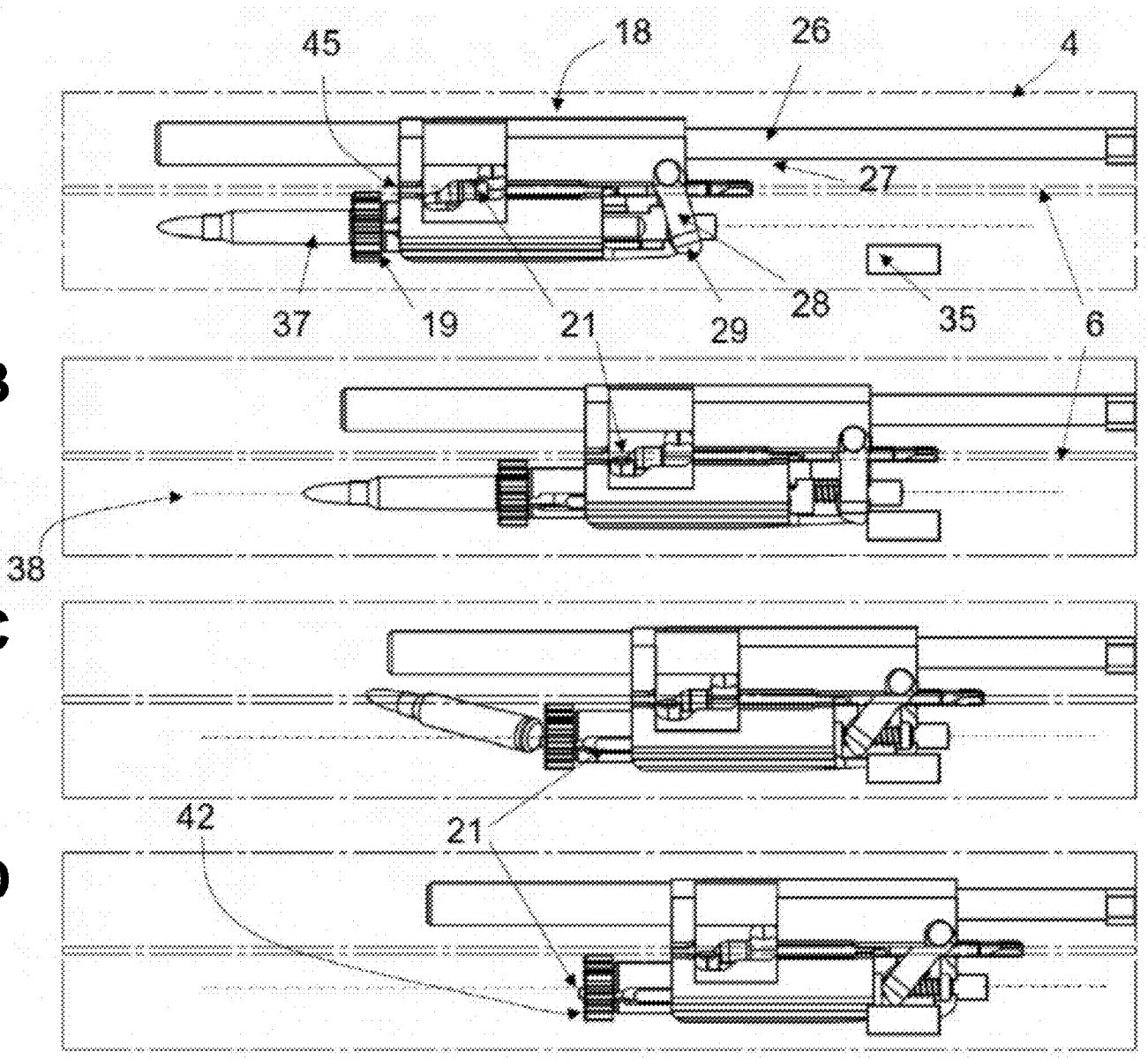
FIGS. 4A-4D depict a sequence of movement of a bolt according to the present disclosure.

The second end position of the ejector lever 28, referred to as the working position, is reached when it hits an impact surface 43 with an ejector surface 39 facing the bolt 19 on its front side, facing away from the bolt 19 on the rear side, at the end of the ejector 21 and has brought it into the foremost position until it stops (FIG. 4D).

The ejector lever 28 may be, but need not be, secured in the rest position by a return device 31 comprising at least one spring element, as explained further below.

In FIG. 3A the ejector lever is designed as a single leg with the leg 29, whose ejector surface 39 can be cambered, which is advantageous for the sliding-rolling contact with the impact surface 43, the Hertzian pressure increased by the camber can be well controlled by surface hardening. The stop to prevent further rotation of the ejector lever 28 is formed by the geometry of the ejector 21 and its movement limitation in the bolt head by the ejector wings 23.

In FIG. 3B the ejector lever 28 is provided with a lever arm 30 in addition to the leg 29 which is opposite the leg in the illustrated embodiment and rests with a projection or stop 33 on an end face 40 of the bolt carrier 18. The stop 33 can also be formed by the lever arm 30 itself, which has, for example, a recess or a flattening matched to the end face 40. The end face 40 is arranged in the direction of the barrel axis 38 in such a way that the lever arm 30 can be deflected forward slightly, i.e. a few degrees, preferably 5 to 30°, relative to a normal to the barrel axis 38 before the stop 33 strikes the end face 40. Such an arrangement of the end face 40 can avoid "overshooting" and thus a possible blocking of the ejector lever 28 of the bolt carrier 18 during return.

In FIG. 3C the variant shown provides a return device 31 for the ejector lever 28, in which the end face 40 is not fixed to the bolt carrier 18, but can deflect against the force of a spring element. When it hits the functional edge (FIG. 4), the ejector lever 28 is deflected away from the resetting device 31 (clockwise in FIG. 3C)—that is, to the "rear". However, as soon as the ejection process is complete and the ejector 21 is moved back to its rest position by the ejector spring 24, "overshooting"—i.e. excessive backward deflection of the leg 29 or of the ejector lever 28—can be avoided and the movement cushioned. The illustration shows the arrangement of the spring as a compression spring acting on the arm 30 in the manner described. If space permits, a tension spring acting on the leg 29 can be provided instead of this compression spring, or a torsion spring arranged around the pivot axis 32, which requires only little space and, moreover, at a favorable location in the bolt carrier 18. The decisive factor is the mode of action, according to which blocking of the ejector lever 28 at the functional edge 35 can be efficiently prevented when the bolt carrier 18 moves back.

In all cases, the ejector lever 28 is designed so that its leg 29 has a length at which, when it is in the rest position, its path of movement collides with a functional edge 35 or functional cam 35' arranged in or connected to the lower housing, lower 10, when it moves with the bolt carrier 18. A slight deflection of the leg 29 to the rear by a few degrees deviating from the normal to the barrel axis 38 is therefore possible, but it is advantageous to avoid "overshooting" or an excessive backward deflection of the leg 29, for example by using a stop according to the description of FIG. 3B or FIG. 3C whereby a blocking of the bolt carrier 18 at the functional edge 35 can be avoided.

This functional edge 35, shown in the FIGS. 4A-4D, has the shape of a step or corner in a section parallel to the center plane of the firearm with a stop surface running normal to the barrel axis 38 and a sliding surface running parallel to the barrel axis, as can be seen clearly in FIGS. 4A-4D. For clarity, the ejection of a cartridge is shown in the illustration (this would be the case in the event of a firing failure and manual movement of the slide) and not the ejection of a case.

The functional cam 35', FIG. 6, is rotatably mounted in the lower 10 between two end positions and also has a stop surface and a sliding surface through which a functional edge is formed. Viewed in section parallel to the center plane 44 of the firearm, the sliding surface runs from the abutment surface obliquely away from the barrel axis to a distance which no longer protrudes into the path of movement of the ejector lever in its rest position. The cam 35' is forced by a spring with its functional edge into the path of movement of the leg 29 and twists it or the ejector lever 28 completely similar to the functional edge. The area of the lower 10 behind the functional cam is designed in such a way that there is no contact between the ejector lever 28 and the lower 10. The slight rotation of the cam under the action of the leading ejector lever does not cause any noticeable axial change in the position of the stop surface of the cam, which is therefore to be regarded as firearm-proof.

The ejector lever thus reaches the rest position, if necessary under the action of its return device 31. When the bolt carrier 18 moves forward under the action of the closing spring of the recoil spring assembly 26, the cam can deflect against the force of the cam spring when the ejector lever 28, which is in the rest position, strikes it. This variant makes it possible, on the one hand, to create a mechanically favorable large overlap between leg and cam and, on the other hand, to prevent the leg from sliding on the sliding surface behind the cam, which is favorable if a high cadence is to be achieved.

This collision between leg 29 and functional edge 35 or functional cam 35' takes place in the so-called "working position" of the individual components as a violent impact, as a result of which the ejector lever is rotated about its pivot axis 32, if necessary against the action of the resetting device 31 (in FIG. 3 clockwise), pushing its ejector surface 39 against the end face 40 of the ejector 21, displacing it against the force of the ejector spring 24 in the direction of the case to be ejected, so that its tip emerges through the breech plate and ejects the case 37 until one the ejector wings 23 prevents further relative movement between the ejector 21 and the breech head 19 and the ejector, breech head and bolt carrier 18 move backwards together.

The purpose of the resetting device is to limit the "overshooting" of the ejector lever. The first force component acts on the leg (29) through the ejector spring (24). To prevent the leg (29) from being deflected too far backwards, a second force component acts through the resetting unit (31) whereby the leg in FIG. 3C is correctly positioned by the force on the stop (33). As an alternative to a second force, a mechanical stop (40) in FIG. 3B or also FIG. 5 can be used.

In this case, the leg 29 of the ejector lever 28 is finally positioned at an angular position on the bolt carrier 18, which depends on the position of the sliding surface 45 and the shape and size of the leg 29 when a functional edge 35 is provided, called ejection position. The ejector wing 23 determines the "absolute" end position of the ejector and thus of the adjacent ejector lever when it rests against the end of its assigned recess. For reasons of tolerance, its end position must be twisted further than when sliding on the sliding surface, otherwise it will impale. This ejection position is at least as far away from the rest position as the sliding position, which is given by the sliding surface, and is thus usually only briefly reached. If a functional cam 35' is provided, in which the leg 29 returns to its rest position without contacting a sliding surface, the ejection position is assumed only briefly.

According to the present disclosure, when the working position is reached, the bolt carrier 18 can continue to move in the direction of its end stop due to its kinetic energy and any propellant gases still acting, whereby, in the case of a functional edge 35, the ejector 21 and thus the ejector lever 28 are forced in the direction of their rest position by the pretensioning of the bolt spring, it rests against the sliding surface and a frictional force can thus be applied.

The embodiment of the ejector mechanism according to the present disclosure leads to a positively controlled triggering of the case or cartridge ejection when the functional edge 35 is reached, the path of the ejector 21 itself is to be taken into account or not, depending on the desired accuracy; i.e. at a defined time and/or at a defined position. In addition, in one variant, the friction between the ejector lever 28, or more precisely its leg 29, and the sliding surface 45 of the functional edge 35 or functional cam 35' arranged in the lower housing 10 reduces the return speed of the breech unit 7, as a result of which, among other things, the firing cadence can be influenced, in particular reduced, when firing bursts or in continuous fire mode.

In the area of its pivot axis 32, the ejector lever 28 has at least one first extension 48 which is provided for mounting in a corresponding receptacle of the bolt carrier 18. This first extension 48 may preferably be bolt-shaped, wherein a projection may be formed at least partially in the circumferential direction in the radial direction around the pivot axis 32, as can be readily seen in FIG. 5 when viewed in conjunction with FIG. 2: The first extension 48 or even the projection on the extension can be flattened in such a way that, when the ejector lever 28 is rotated into the working position, it can be inserted into the bolt carrier 18 or removed therefrom.

Figures 5A, 5B, 5C:
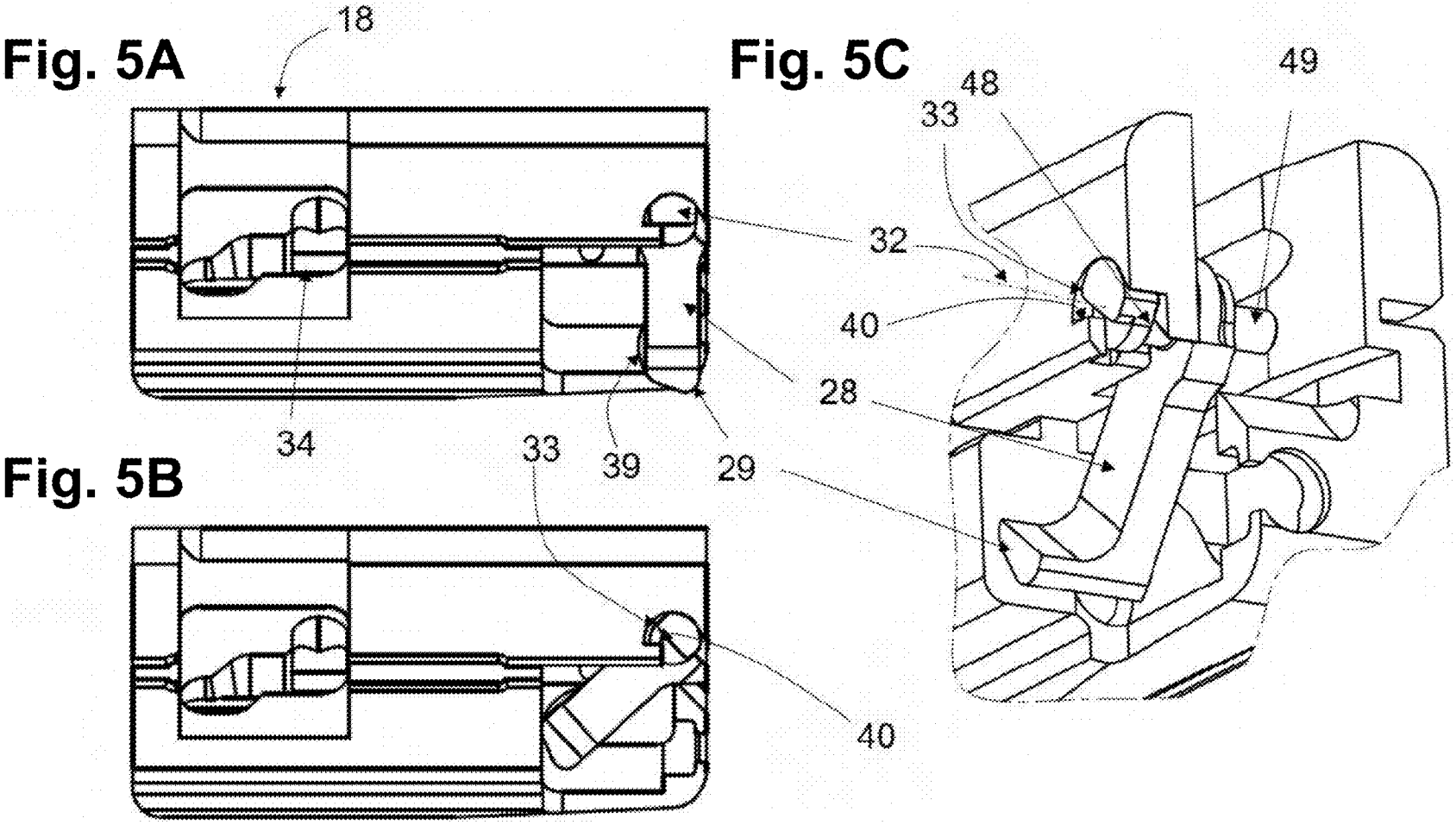
FIGS. 5A-5C depict an alternative variant of the ejector lever according to the present disclosure.

A possible such shape of this first extension 48 with a projection is particularly clear from the oblique view in FIG. 5C. In this embodiment, a flattening is provided on the first extension and/or a projection that is not fully formed. Such a flattening or extension can simultaneously serve as a stop 33, which interacts with an end face 40 of the bolt carrier 18 (FIG. 5A), similar to the mode of operation of the embodiment with a lever arm 30 as described with reference to FIG. 3.

By suitably designing the first extension 48 and/or a projection, the ejector lever 28 is also guided or supported in the direction of the pivot axis 32 on the bolt carrier 18 during activation and rotation in the direction of its working position, and twisting or skewing of the ejector lever 28 can be efficiently avoided. This favors the safe triggering of the ejection and, in addition, the forces acting on the ejector lever 28 are well transmitted to the bolt carrier 18. Furthermore, the fatigue strength of the ejector lever 28 can be increased because a bending stress at the pivot point, i.e. around the pivot axis 32, is reduced. In addition, the ejector lever 28 can preferably be designed in one piece, e.g. as a milled part or metal injection molding (MIM), whereby the number of components for the closure unit 7 can remain small and still enable good disassembly and maintenance/cleaning.

Figure 7A:
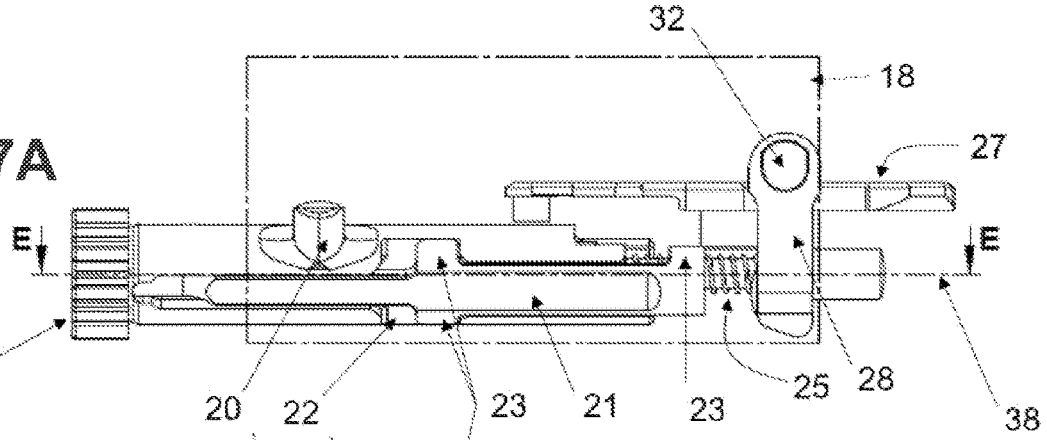
FIGS. 7A-7C depict an illustrative bolt carrier of the present disclosure in its entirety in two views and a sectional view.
Figure 7B:
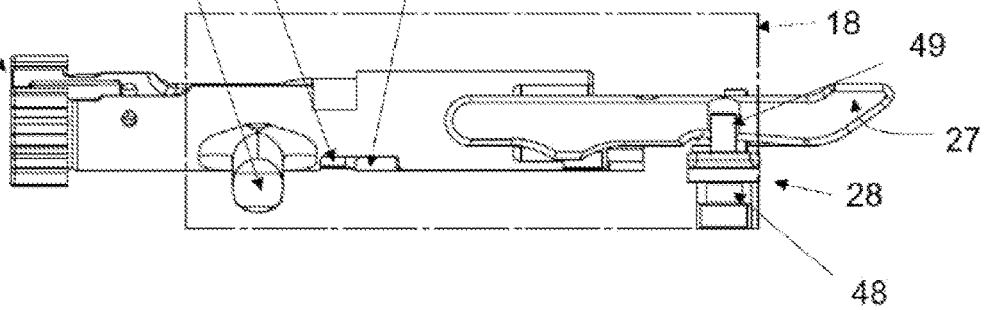
Figure 7C:
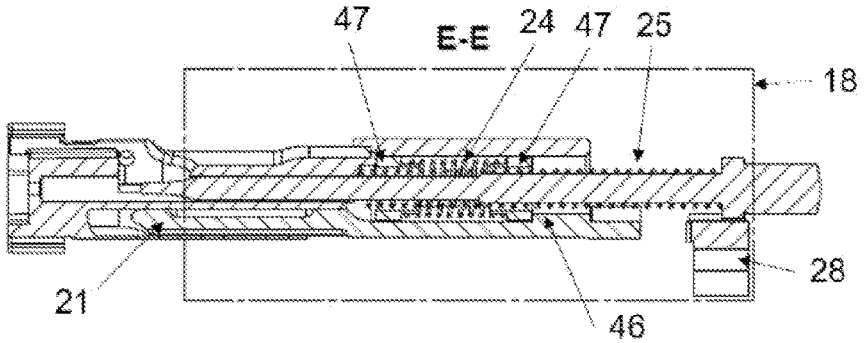

Particularly preferred is a shape of the ejector lever 28 which has two opposing radial extensions 48, 49 with respect to and along the pivot axis 32, as shown in FIG. 5C. In this regard, it is advantageous if the second extension 49 has a length such that it at least temporarily protrudes beyond the firing pin safety device 27 (FIGS. 7A-7C). A projection, similar to the first extension 48 described above, can be provided under certain circumstances, but is not absolutely necessary for the advantages explained below.

The second extension 49 on the ejector lever 28 enables a particularly simple assembly of the closure unit 7, as can be seen directly from FIG. 5C in conjunction with FIGS. 7A-7C: Since the ejector lever 28 only has to be inserted into the recess provided for this purpose on the bolt carrier and the loss prevention is effected by means of the firing pin safety device 27 accommodated in the bolt carrier 18, the installation can be carried out in the simplest manner. In addition, the second extension 49 can be used as a driver for the recoil spring assembly 26, which makes it possible to simultaneously and very easily remove the bolt carrier 7 together with the closing spring 26 from the upper 4.

The firing pin safety 27 is usually spring-loaded and is normally only deflected laterally by the hammer when the shot is fired. When inserting the ejector lever 28, the firing pin safety 27 is manually deflected to the side, whereby the second extension 49 of the ejector lever 28 can be moved past the firing pin safety device 27 without hindrance and the ejector lever 28 can be inserted into the recess provided for this purpose in the bolt carrier 18. In the manner described, additional securing elements of the ejector lever 28, such as pins, screws or the like, can be dispensed with. During operation, the ejector lever 28 is additionally prevented from relative movement—except for the intended rotation—by the firing pin safety device 27, thus enabling stable guidance and at the same time loss prevention.

In order to ensure reliable movement of the bolt carrier 18 in the direction of the end position, it has proven to be advantageous for the ejector lever 28 not to be able to be deflected backwards beyond its rest position, as otherwise the leg 29 may become blocked with the functional edge 35 or functional cam 35'. Several possibilities are disclosed in the following section, which are intended to serve as suggestions for the person skilled in the art and represent a non-exhaustive list of configurations.

In a relatively simple configuration, the bolt-shaped projection of the first extension 48 or the entire extension of the ejector lever 28 may include a stop 33. Such a stop 33 can, for example, be designed as a projection in the shape of a gate or semicircle in order to interact with a corresponding stop 33 on the bolt carrier 18. (see FIGS. 5A-5C).

Such a stop 33 on the bolt carrier 18 and on the extension is relatively easy to produce and reduces the required number of components while maintaining a high level of safety.

In another preferred configuration, the ejector lever 28 may include a second lever arm 30 formed from the pivot axis 32 substantially opposite the leg 29. (See FIG. 3B) In this case, a stop 33 is to be provided on the second lever arm 30, which interacts with the bolt carrier 18 and limits the rotation of the leg 29 to the rear.

In another preferred configuration, the ejector lever 28 may be under the action of a spring element (part of the reset device 31) which forces it in the direction of the inactive position, i.e., the rest position. (FIG. 3C)

This ensures particularly well that the ejector lever 28 is in a predefinable rest position when the functional edge 35 or functional cam is reached during the return movement of the bolt carrier 18 in the direction of the end position.

In some cases, it may also be advantageous for the functional edge 35 or even a functional cam of the lower housing 10 to be at least partially movable, acting rigidly with respect to the ejector lever 28 during the return movement of the bolt carrier 18 when the ejector lever 28 is actuated, and tilting or rotating away downwardly during the forward movement. (FIG. 6).

This measure has the advantage that safe triggering of the ejector mechanism can be decoupled from any friction losses caused by the ejector lever 28 on the lower housing 10.

FIGS. 7A-7C also clearly show how the ejector 21 together with its ejector spring 24 can be advantageously accommodated and guided in the bolt carrier 18: FIG. 7A shows a side view of the ejector wings 23, which are provided at approximately the midpoint of the longitudinal extent and at the rear end. These interact with ejector recesses 22 on the bolt carrier 18; in the illustrated configuration, the rear recess is reduced to a clearance.

An ejector spring 24 is provided coaxially outside the firing pin spring 25, see FIG. 7C in conjunction with FIG. 2. A spring plate 47 with a case can be inserted into this ejector spring 24 on both sides, so that both cases are directed toward one another. The outer diameter of the cases is smaller than the inner diameter of the ejector spring 24, and the inner diameter of the cases is larger than the outer diameter of the firing pin spring. The overall length of the cases has an upper limit such that when the spring is compressed during the ejection movement of the ejector 21, this movement is not impeded.

The ejector 21 interacts by means of a thickening 46 on its rear side with a spring plate 47 arranged on the ejector spring 24 and is thus forced backwards, into its rest position, which in turn is determined by ejector recesses 22 on the guide piece 18 in conjunction with the ejector wings 23. By appropriate choice of the axial extent of said elements, one can achieve a prestressing of the ejector spring 24 or not, depending on the needs.

The two spring plates 47 are preferably identical, so that it is not necessary to pay attention to orientation both during assembly and insertion (FIG. 2, reference 24). If the cases have a larger diameter in the immediate vicinity of the plate, it is possible to mount them captively on the spring 24 by clamping.

FIGS. 7A-7B also show the cam pins 20 behind the bolt 19, which determine the angular position of the bolt by means of control cams 34 in the bolt carrier 18.

FIG. 8 shows the ejector 21 in two views on an enlarged scale, the ejector wings 23 are clearly visible, which are formed laterally normal to the longitudinal extension of the ejector 21. Two of the ejector wings (23) are arranged opposite one another in the axially central area. These ejector wings 23 are provided to minimize momentum being introduced into the ejector 21 when it runs into the end of the associated recess 22, thus allowing it to be constructed to be lightweight yet strong. In the illustrated configuration, a further, rear extension or ejector wing 23 can be seen, which is arranged directly adjacent to the impact surface 43. As FIG. [[7*a*]] 7A shows, the ejector lever 28 strikes this impact surface 43 with full force. The solid design of the rear end of the ejector 21 and the further associated stop surface on the bolt carrier (no reference number) limit the axial load.

In summary, it can thus be stated that the present disclosure provides the following:

A firearm with cartridge-case ejection, in particular a rifle, with a barrel 1 with a barrel axis 38, a bolt carrier 18, which can be moved parallel to the barrel axis 38, with a bolt 19 which, in the ready-to-fire position, forms a chamber for a cartridge, in particular a breech face 42, with the barrel 1, with an ejector 21 that can be moved parallel to the barrel axis 38 in the bolt 19 and that protrudes with its rear end out of the bolt carrier 18 between a rest position in which its front end does not protrude beyond the breech face 42, and an ejection position in which it protrudes at its front end beyond the breech face 42, with an ejector spring 24, which forces the ejector 21 into the rest position, with a functional edge 35 which is fixed to the firearm in the direction of the barrel axis 38 and which, when the bolt carrier 18 moves back after a shot has been fired, pushes the ejector 21 in its ejection position, characterized in that on the bolt carrier 18 an ejector lever 28 is preferably arranged around a pivot axis 32 running normal to the firearm center plane 44 is rotatable between a rest position and an ejection position, that the ejection lever has a leg 29 which lies in the path of the relative movement of the functional edge 35 in the rest position of the ejector lever 28, that the ejector lever has an ejector surface 39, which, when rotated from the rest position to the ejection position, strikes an impact surface 43 of the ejector 21 and forces it into the ejection position.

Advantageous developments and variants are, for example, the following:

In one configuration, the ejector lever 28 includes at least a first extension 48 along its pivot axis 32 having a projection formed at least partially circumferentially and projecting radially transverse to the pivot axis 32 relative to the diameter of the first extension 48.

A further development is characterized in that the ejector lever 28 in the region of the pivot axis 32, preferably on the first extension 48, has a flattening and/or a projection that is not fully formed.

In one variant it is provided that the ejector lever 28 has a stop 33 which is designed to interact with an end face 40 of the bolt carrier 18 in such a way that the ejector lever 28 is prevented from overshooting backwards.

Another configuration is characterized by the ejector lever 28 having a lever arm 30 which includes a stop 33

One variant provides that the lever arm 30 is orientated diametrically to the leg 29.

One configuration is characterized by that the bolt carrier 18, has at least one resetting device 31 with a spring element.

One variant is characterized by the spring element of the resetting device 31 being a compression spring.

One development is characterized by the ejector lever 28 having a second extension 49 which is aligned with the first extension 48.

A further configuration is characterized by the second extension 49 having a length in the direction of the pivot axis 32, with which it at least partially protrudes beyond a firing pin safety 27 when the firearm is in the rest position and releases the ejector lever 28 when the firing pin safety 27 is manually deflected.

Another configuration is characterized by the functional edge 35 being movably mounted, preferably rotatable around an axis fixed to the firearm.

This is advantageously characterized by the fact that the firearm-fixed axis is normal to the firearm center plane 44.

One variant is characterized by the functional edge 35 being formed on a functional cam.

Advantageously, the firearm is characterized in that the firearm-fixed axis is arranged behind the functional edge 35, viewed in the direction of barrel travel.

The firearm is preferably also characterized by the ejector spring 24 having at least one spring plate 47.

A further development is characterized by the ejector spring 24 having two spring plates 47 of the same size and form.

Yet another configuration is characterized by the ejector 21 having a flat cross-section and having at least one ejector wing 23 projecting transversely to the longitudinal extension of the ejector 21.

A further development is characterized by the ejector wing(s) 23 being designed to be curved out of the plane thus formed with respect to the flat shape of the ejector 21.

One configuration is characterized by the ejector 21 being provided with at least two ejector wings 23 opposite one another with respect to the longitudinal extension of the ejector. (FIG. 2)

A further development is characterized by the ejector 21 having, in its rear region of the impact surface 43 facing the ejector lever 28, a broadened area designed as an additional ejector wing 23. (FIG. 8)

To put it very briefly, one can say that the invention relates to a firearm with cartridge-case ejection, in particular a rifle, with a barrel 1 with a movable bolt carrier 18 with a bolt 19, with a breech face 42, with a movable ejector 21 and with a barrel axis 38 firearm-fixed functional edge 35 which pushes the ejector 21 into its ejection position when the bolt carrier 18 returns after firing a shot. To ensure that the ejection is always uniform, an ejector lever 28 is arranged on the slide 18 so that it can be rotated about a pivot axis 32 extending normal to the center plane 44 of the firearm. When the slide 18 moves backward, the lever abuts the functional edge 35 and is twisted in the process so that it abuts an impact surface 43 of the ejector 21 and forces it into the ejection position.

The present disclosure is not limited to the illustrated and described configurations, but can be modified and designed in various ways. In particular, the individual configurations of the ejector lever 28 can be freely combined with the individual configurations of the ejector 21 and/or the individual configurations of the functional edge/functional cam 35.

In the description and the claims, the terms "front", "rear", "top", "bottom" and so on are used in the usual form and with reference to the object in its usual position of use. This means that with a firearm, the muzzle of the barrel is "in front", that the bolt or slide is moved "backwards" by the explosion gases, etc. Transverse to a direction essentially means a direction rotated 90° to it.

It should also be pointed out that in the description and claims, indications such as "lower region" of a hanger, reactor, filter, structure, or a device or, more generally, an object refers to the lower half and particularly to the lower quarter of the total height; "lowest region" refers to the lowest quarter (or less); while "middle area" refers to the middle third of the total height (width–length). All these indications have their usual meaning, applied to the intended position of the considered object; the same applies, of course, to "front" and "rear".

In the description and claims, "substantially" means a deviation of up to 10% of the indicated value, if physically possible, both downward and upward, otherwise only in the reasonable direction; for degrees (angle and temperature), this means±10°.

All quantities and proportions, particularly those that delimit the invention, insofar as they do not relate to the specific examples, are to be understood to have a ±10% tolerance. For example: 11% means: from 9.9% to 12.1%. With designations as in: "a solvent", the word "a" is not to be regarded as a numerical word, but as an indefinite article, unless the context indicates otherwise.

The term: "combination" or "combinations" refers to all types of combinations, starting from two of the components concerned to a large number of such components, unless otherwise stated. The term "containing" also stands for "consisting of".

The features and variants indicated in the individual configurations and examples may be freely combined with those of the other examples and configurations and, in particular, may be used to identify the invention in the claims, without necessarily entraining the other details of the respective configuration or example.

REFERENCE SYMBOL LIST

| | |
|---|---|
| 1 | Barrel |
| 2 | Gas system |
| 3 | Barrel extension |
| 4 | Upper housing or upper |
| 5 | Carrier module |
| 6 | Guid |
| 7 | Bolt carrier group |
| 8 | Charging handle unit |
| 9 | Handguard |
| 10 | Lower housing or lower |
| 11 | Magazine catch |
| 12 | Trigger unit |
| 13 | Grip |
| 14 | Bolt catch |
| 15 | System lock |
| 16 | Magazine |
| 17 | Stock |
| 18 | Bolt carrier |
| 19 | Bolt |
| 20 | Cam pin |
| 21 | Ejector |
| 22 | Ejector recess |
| 23 | Ejector wings |
| 24 | Ejector spring |
| 25 | Firing pin with spring |
| 26 | Recoil spring assembly |
| 27 | Firing pin safety |
| 28 | Ejector lever |
| 29 | Leg |
| 30 | Lever arm |

-continued

| | |
|---|---|
| 31 | Resetting device |
| 32 | Pivot axis |
| 33 | Stop |
| 34 | Control cam |
| 35 | Functional edge or cam |
| 37 | Cartridge or case |
| 38 | Barrel axis |
| 39 | Ejector surface |
| 40 | End face |
| 42 | Breech face |
| 43 | Impact surface |
| 44 | Firearm center plane |
| 45 | Sliding surface |
| 46 | Thickening |
| 47 | Spring plate |
| 48 | First extension |
| 49 | Second extension |

The invention claimed is:

1. A firearm with cartridge-case ejection, comprising:

a barrel with a barrel axis;

a bolt carrier that can be moved parallel to the barrel axis;

a functional edge that is coupled to the firearm rearward of the bolt carrier in a direction of the barrel axis;

the bolt carrier including:

a bolt that, when in a ready-to-fire position, and in combination with the barrel, forms a cartridge chamber;

an ejector having a rear end that protrudes beyond the bolt carrier, where the ejector can be moved in the bolt parallel to the barrel axis between an ejector rest position in which a front end of the ejector does not protrude beyond a breech face and an ejector ejection position in which the front end of the ejector protrudes beyond the breech face;

an ejector spring that urges the ejector into the ejector rest position; and an ejector lever that is arranged on the bolt carrier so that it can rotate about an ejector lever pivot axis between an ejector lever rest position and an ejector lever ejection position, the ejector lever including:

a leg disposed in a path of a relative movement of the functional edge when the ejector lever is in the ejector lever rest position; and an ejector surface that, when the ejector lever is rotated from the ejector lever rest position to the ejector lever ejection position, contacts an impact surface of the ejector and pushes it into the ejector ejection position;

wherein the firearm is configured so that the functional edge urges the ejector into the ejector ejection position when the bolt carrier moves rearward after a shot has been fired.

2. The firearm according to claim 1, wherein the ejector lever pivot axis is normal to a firearm center plane of the firearm.

3. The firearm according to claim 1, wherein when in the ready-to-fire position, the bolt forms a cartridge chamber in combination with a breech face of the barrel.

4. The firearm according to claim 1, wherein the ejector lever has a flattening and/or a projection in an area of the ejector lever pivot axis that is not fully formed in a circumferential direction.

5. The firearm according to claim 1, wherein the ejector lever has at least one first extension along the ejector lever pivot axis, the at least one first extension having a protruding projection that at least partially extends in a circumferential direction, relative to a diameter of the first extension in a radial direction transverse to the ejector lever pivot axis.

6. The firearm according to claim 5, wherein the ejector lever has a flattening and/or a projection on the first extension in an area of the ejector lever pivot axis that is not fully formed in a circumferential direction.

7. The firearm according to claim 1, wherein the ejector lever includes a stop that interacts with an end face of the bolt carrier to prevent the ejector lever from overshooting backwards.

8. The firearm according to claim 1, wherein the ejector lever includes a lever arm that includes a stop that interacts with an end face of the bolt carrier to prevent the ejector lever from overshooting backwards.

9. The firearm according to claim 8, wherein the lever arm runs diametrically to the leg of the ejector lever.

10. The firearm according to claim 1, wherein the bolt carrier includes at least one resetting device having a spring element.

11. The firearm according to claim 10, wherein the spring element of the resetting device is a compression spring.

12. The firearm according to claim 5, wherein the ejector lever has a second extension that is aligned with the at least one first extension.

13. The firearm according to claim 12, further comprising a firing pin safety, wherein the second extension has a length in a direction of the ejector lever pivot axis that projects at least partially beyond the firing pin safety when the firearm is in the rest position, such that when the firing pin safety is manually deflected the firing pin safety releases the ejector lever.

14. The firearm according to claim 1, wherein the functional edge is movably mounted to the firearm.

15. The firearm according to claim 14, wherein the functional edge is rotatable about an axis that is stationary relative to the firearm.

16. The firearm according to claim 15, wherein the axis that is stationary relative to the firearm runs normal to a firearm center plane of the firearm.

17. The firearm according to claim 14, wherein the functional edge is formed on a functional cam.

18. The firearm according to claim 15, wherein the axis that is stationary relative to the firearm is disposed behind the functional edge.

19. The firearm according to claim 1, wherein the ejector spring includes at least one spring plate.

20. The firearm according to claim 19, wherein the ejector spring includes two identical spring plates.

21. The firearm according to claim 1, wherein the ejector has a flat cross-section and is provided with at least one ejector wing.

22. The firearm according to claim 21, wherein the at least one ejector wing is curved out of a plane formed with respect to the flat cross-section of the ejector.

23. The firearm according to claim 21, wherein the ejector is provided with at least two ejector wings disposed opposite to one another with respect to a longitudinal extension of the ejector.

24. The firearm according to claim 21, wherein at a rear region of the ejector adjacent to the impact surface and facing the ejector lever, the ejector includes an additional broadening designed as an ejector wing.

25. The firearm according to claim 1, wherein the firearm is a rifle.

* * * * *